US006361631B2

(12) United States Patent
Scheffee et al.

(10) Patent No.: US 6,361,631 B2
(45) Date of Patent: Mar. 26, 2002

(54) LIQUID MONOPROPELLANTS FOR PASSIVE VEHICLE OCCUPANT RESTRAINT SYSTEMS

(75) Inventors: Robert S. Scheffee, Lorton; James D. Martin, Manassas, both of VA (US)

(73) Assignee: Atlantic Research Corporation, Gainesville, VA (US)

( * ) Notice: Subject to any disclaimer, the term of this patent is extended or adjusted under 35 U.S.C. 154(b) by 0 days.

(21) Appl. No.: 09/861,775

(22) Filed: May 22, 2001

Related U.S. Application Data

(62) Division of application No. 09/467,019, filed on Dec. 20, 1999.

(51) Int. Cl.[7] ..... D03D 23/00; C06B 31/00; C06D 5/00

(52) U.S. Cl. ..... 149/109.4; 149/45; 60/214; 60/215

(58) Field of Search ..... 149/74, 109.4, 149/109.2, 45; 60/205, 211, 214, 215

(56) References Cited

U.S. PATENT DOCUMENTS

| | | | | | |
|---|---|---|---|---|---|
| 3,465,675 | A | | 9/1969 | Bronstein | 102/23 |
| 3,662,555 | A | * | 5/1972 | Ayers et al. | 60/220 |
| 3,700,393 | A | * | 10/1972 | Mueller | 60/214 |
| 4,047,988 | A | * | 9/1977 | Weill et al. | 149/74 |
| 5,223,957 | A | | 6/1993 | Mueller et al. | 149/45 |
| 5,607,181 | A | * | 3/1997 | Richardson et al. | 280/737 |
| 5,683,104 | A | | 11/1997 | Smith | 280/736 |
| 5,803,492 | A | | 9/1998 | Rink et al. | 280/737 |
| H1768 | H | * | 1/1999 | Mueller et al. | 149/46 |
| 5,951,043 | A | | 9/1999 | Mooney et al. | 280/741 |
| 5,972,136 | A | * | 10/1999 | Wagaman et al. | 149/46 |
| 6,165,295 | A | * | 12/2000 | Wagaman | 149/46 |

* cited by examiner

*Primary Examiner*—Michael J. Carone
*Assistant Examiner*—Aileen J. Baker
(74) *Attorney, Agent, or Firm*—Nixon & Vanderhye P.C.

(57) ABSTRACT

Liquid monopropellants for passive vehicle restraint systems (e.g., air bags) include an aqueous solution of a water-soluble oxidizer and a water-soluble organic fuel miscible with the oxidizer. The oxidizer is most preferably ammonium nitrate, hydrogen peroxide or nitric acid, while the fuel is a lower alcohol such as methanol, ethanol, propanol or glycerol. The liquid monopropellants will advantageously have an oxidation ratio ($O_R$) of greater than about 0.90.

20 Claims, No Drawings

LIQUID MONOPROPELLANTS FOR PASSIVE VEHICLE OCCUPANT RESTRAINT SYSTEMS

This is a divisional of application Ser. No. 09/467,019, filed Dec. 20, 1999, now pending, the entire content of which is hereby incorporated by reference in this application.

FIELD OF THE INVENTION

The present invention relates generally to gas generant compositions, especially liquid gas generant compositions employed in the inflation of passive vehicle occupant restraint systems.

BACKGROUND AND SUMMARY OF THE INVENTION

Various inflators for inflating passive vehicle occupant restraint systems (known colloquially in the art as "air bags") are known. Among the various types of inflators is one that utilizes a quantity of stored compressed gas which is selectively released to inflate the air bag. A related type of inflator generates a gas source from a solid combustible gas-generating material which, upon ignition, provides a quantity of gas sufficient to inflate the air bag. In still another type (known as a hybrid inflator), the air bag inflating gas is provided by the combination of a stored compressed gas and the combustion products of the gas generating material.

Inflators which depend entirely or partially on the generation of gases by virtue of combustion of solid combustible materials have several disadvantages. For example, the burning of the propellant and the initiation materials in such inflators results in the production of undesired particulate matter. Thus, using inflators that are particulate-containing or which generate particulates upon combustion as part of a passive restraint system in a vehicle might result in undesirable particulates being released into the occupant zone of the vehicles and thereby inhaled by the occupants.

One prior inflator is disclosed in commonly owned U.S. Pat. No. 5,589,141 to Sides et al (the entire content of which is expressly incorporated hereinto by reference). In the Sides et al '141 patent, the composition of the inflator comprises conducting ignition in the presence of an ammonium nitrate oxidizer and using a suitable propellant, e.g., aminoguanidine nitrate or a nitramine, such as hexahydro-1,3,5-trinitro-s-triazine (RDX) and/or octahydro-1,3,5,7-tetranitro-1,3,5,7-tetrazine (HMX), and in the presence of argon and a molecular oxygen-containing gas. The ratio of the oxygen-containing gas to argon is variably selected so as to provide only non-toxic reaction products in the exhaust gas.

There is still a desire to develop particulate-free propellants for air bags. It is towards fulfilling that desire that the present invention is directed.

Broadly, the present invention is embodied in liquid monopropellants for passive vehicle restraint systems (e.g., air bags) comprised of an aqueous solution of a water-soluble oxidizer and an alcohol fuel miscible with the oxidizer. Most preferably, the oxidizer is ammonium nitrate or hydrogen peroxide, while the alcohol fuel is a lower alcohol such as methanol, ethanol or propanol.

The liquid monopropellants of this invention will advantageously have an oxidation ratio ($O_R$) of greater than about 0.95, and more preferably greater than about 1.00 thereby yielding suppressed amount of carbon monoxide and hydrogen combustion gases. As a result, the combustion products of the liquid monopropellants of this invention will be essentially non-toxic and non-flammable. Furthermore, combustion of the monopropellants in accordance with this invention will be particulate-free.

These and other aspects and advantages will become more clear from the following detailed description of the preferred exemplary embodiments thereof.

DETAILED DESCRIPTION OF THE PREFERRED EXEMPLARY EMBODIMENTS

The gas generant solutions of this invention are liquid monopropellants. As used herein and in the accompanying claims, the term "monopropellant" and like terms is meant to refer to a liquid mixture in which the oxidizer and fuel are dissolved in one another to form a miscible liquid solution thereof. The liquid monopropellants of this invention, moreover, are aqueous—that is, contain a significant amount of water. Most preferably, the liquid monopropellants will contain at least about 20 wt. % of water, and more preferably between about 20 wt. % to about 35 wt. % water. All weight percentages expressed herein are based on the total weight of the liquid monopropellant.

The liquid monopropellants will necessarily comprise a water-soluble oxidizer. Most preferably, the oxidizer is ammonium nitrate (AN), hydrogen peroxide ($H_2O_2$) or nitric acid ($HNO_3$). The oxidizer will be present in an amount of at least about 50 wt. %, and more preferably between about 60 wt. % to about 75 wt. %.

The fuel employed in the liquid monopropellants of this invention is a water-soluble organic compound that is miscible with the oxidizer. Most preferably, the fuel is a lower alcohol, such as methanol, ethanol, propanol (e.g., isopropanol), butanol, pentane diol, allyl alcohol, glycerol and the like. The alcohol fuel will be present in an amount between about 5 wt. % to about 15 wt. %.

Other organic fuels that are soluble in water and/or alcohols that may be employed in the practice of this invention include guanidine, guanidine nitrate, guanidine carbonate, guanidine acetate, cyanoguanidine, aminoguanidine nitrate (and other aminoguanidine analogs of the guanidine compounds) glycine and its water/alcohol soluble derivatives, water-soluble organic acids, amines, amides, ethers, esters, nitriles and the like. In addition water-dispersible compounds such as surfactants (alkylphenyl hydroxy terminated polyethers), gums such as guar gum xanan gum, cellulosics, starches and the like, may be used if desired. These fuels may be used singly or in combinations of two or more or the same.

The three necessary components—that is, oxidizer, fuel and water—will be present in an amount sufficient to yield an oxidation ratio ($O_R$) which is greater than about 0.90. For example, in nitrogen-containing propellants, the oxidation ratio should be between about 0.90 to about 1.0. IN propellants that do not contain nitrogen, the oxidation ratio should be greater than about 1.0.

The present invention will be further understood from the following non-limiting Examples.

EXAMPLES

Example 1

A liquid monopropellant is made by forming a solution of 66.662 wt. % ammonium nitrate (AN), 10.7 wt. % methanol (MeOH) and 26.638 wt. % water. When combusted, the liquid monopropellant will generate 4.8283 moles gas per 100 grams at a flame temperature of 1315° K.

Example 2

A liquid monopropellant is made by forming a solution of 61.769 wt. % ammonium nitrate (AN), 7.614 wt. % methanol (MeOH) and 30.617 wt. % water. When combusted, the liquid monopropellant will generate 4.8398 moles gas per 100 grams at a flame temperature of 1216° K.

Example 3

Liquid monopropellants containing hydrogen peroxide are made by forming solutions of the components noted in Table A below. The liquid monopropellants will exhibit the flame temperatures, gas yields and oxygen ratios as enumerated in Table A.

TABLE A

| | | | Alcohol Fuel | | Flame | Gas | Oxidation |
|---|---|---|---|---|---|---|---|
| ID No. | Water, wt. % | H2O2, wt. % | Amt., wt. % | Type | Temp, ° K. | Yield, m/100 g | Ratio ($O_R$) |
| 1 | 20 | 73 | 7 | EtOH | 1649 | 4.6334 | 1.29 |
| 2 | 30 | 60 | 10 | " | 1765 | 4.7456 | 1.09 |
| 3 | 32 | 56 | 12 | " | 1904 | 4.7675 | 1.02 |
| 4 | 20 | 74 | 6 | 2-PrOH | 1637 | 4.6232 | 1.30 |
| 5 | 30 | 60 | 10 | " | 1897 | 4.7279 | 1.05 |
| 6 | 32 | 57 | 11 | " | 1965 | 4.7487 | 1.005 |

Notes: EtOH = ethanol;
2-PrOH = isopropanol

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A liquid monopropellant for passive vehicle restraint systems comprising an aqueous solution of a water-soluble oxidizer which is at least one selected from the group consisting of hydrogen peroxide and nitric acid, and an organic fuel miscible with said oxidizer and water.

2. The liquid monopropellant as in claim 1, wherein the fuel is at least one alcohol selected from the group consisting of methanol, ethanol, propanol, butanol, pentane diol, allyl alcohol and glycerol.

3. The liquid monopropellant as in claim 1, wherein the fuel is at least one water-soluble compound selected from the group consisting of guanidine, guanidine nitrate, guanidine carbonate, guanidine acetate, cyanoguanidine, aminoguanidine nitrate, glycine and its water and/or alcohol soluble derivatives, water-soluble organic acids, amines, amides, ethers, esters, nitriles, water-dispersible surfactants, gums, cellulosics, and starches.

4. The liquid monopropellant as in claim 1, comprising greater than about 20 wt. % water, based on total weight of the monopropellant.

5. The liquid monopropellant as in claim 4, wherein water is present in an amount between about 20 wt. % to about 35 wt. %.

6. The liquid monopropellant as in any one of claims 1–5, which consists of said oxidizer, said fuel and water.

7. The liquid monopropellant as in claim 1 or 4, comprising at least about 50 wt. % of said oxidizer, based on total monopropellant weight.

8. The liquid monopropellant as in claim 7, wherein said oxidizer is present in an amount between about 60 wt. % to about 75 wt. %.

9. The liquid monopropellant as in claim 8, wherein said fuel is an alcohol fuel which is present in an amount between about 5 wt.% to about 15 wt.%, based on total monopropellant weight.

10. The liquid monopropellant as in claim 1, having an oxidation ratio of greater than about 0.90.

11. The liquid monopropellant as in claim 1, wherein the oxidizer is hydrogen peroxide, and wherein the monopropellant has an oxidation ratio of greater than about 1.00.

12. A liquid monopropellant for passive vehicle restraint systems which consists essentially of, based on total monopropellant weight:

(a) a hydrogen peroxide and/or nitric acid oxidizer present in an amount between about 60 wt.% to about 75 wt.%;

(b) an alcohol fuel present in an amount between about 5 wt. % to about 15 wt. %.; and (c) the balance, water.

13. The liquid monopropellant as in claim 12, wherein the fuel (b) is methanol, ethanol, propanol or glycerol.

14. The liquid monopropellant as in claim 12, wherein the oxidizer (a) is hydrogen peroxide, and wherein the fuel (b) is methanol, ethanol, propanol or glycerol.

15. The liquid monopropellant as in claim 12, wherein the oxidizer (a) is nitric acid, and wherein the fuel (b) is methanol, ethanol, propanol or glycerol.

16. The liquid monopropellant as in claim 12, wherein the fuel is isopropanol.

17. The liquid monopropellant as in claim 12, having an oxidation ratio of greater than about 0.90.

18. The liquid monopropellant as in claim 12, wherein the oxidizer (a) is hydrogen peroxide, and wherein the monopropellant has an oxidation ratio of greater than about 1.00.

19. A passive vehicle restraint system which includes a liquid monopropellant as in any one of claims 1, 12, 13, 14, 15, 16, 17 or 18.

20. A liquid monopropellant for passive vehicle restraint systems which consists of a mixture of hydrogen peroxide, an alcohol fuel and water.

* * * * *